US005419348A

United States Patent [19]

Kuta

[11] Patent Number: 5,419,348

[45] Date of Patent: May 30, 1995

[54] NOZZLE SPRAY ASSEMBLY

[75] Inventor: Ken Kuta, Rockford, Ill.

[73] Assignee: PepsiCo, Inc., Purchase, N.Y.

[21] Appl. No.: 90,411

[22] Filed: Jul. 12, 1993

[51] Int. Cl.[6] ..... B08B 9/08

[52] U.S. Cl. ..... 134/58 R; 134/62; 134/66; 134/144; 134/167 R; 134/157; 134/181

[58] Field of Search ..... 134/45, 167 R, 172, 134/152, 131, 62, 144, 66, 181, 153, 158, 157, 142, 113, 58 R, 57 R

[56] References Cited

U.S. PATENT DOCUMENTS

| | | | |
|---|---|---|---|
| 908,446 | 1/1909 | Court | 134/144 |
| 1,151,259 | 8/1915 | Fischer . | |
| 1,539,031 | 5/1925 | Thomson | 134/167 R |
| 1,652,599 | 12/1927 | Ayers . | |
| 1,803,425 | 5/1931 | Cunningham . | |
| 1,940,615 | 12/1933 | Webster | 134/167 R |
| 2,227,734 | 1/1941 | Meyer . | |
| 2,396,449 | 3/1946 | Wahlin . | |
| 2,466,182 | 4/1949 | Peeps . | |
| 2,563,130 | 8/1951 | Mylchreest | 134/167 R X |
| 2,655,929 | 10/1953 | Herold . | |
| 2,691,549 | 10/1954 | Hayward . | |
| 2,835,532 | 5/1958 | Galloway . | |
| 2,907,688 | 10/1959 | Payne, Jr. | 134/152 X |
| 2,910,992 | 11/1959 | Wilcox | 134/152 X |
| 2,925,224 | 2/1960 | Cunningham . | |
| 3,006,557 | 10/1961 | Jacobs . | |
| 3,226,757 | 1/1966 | Shea . | |
| 3,240,216 | 3/1966 | Sadwith | 134/152 X |
| 3,302,655 | 2/1967 | Sasaki et al. . | |
| 3,419,147 | 12/1968 | Corby | 134/62 X |
| 3,534,749 | 10/1970 | Till . | |
| 3,536,263 | 10/1970 | Parker . | |
| 3,563,256 | 2/1971 | Babunovic | 134/144 |
| 3,804,103 | 4/1974 | Cozzoli . | |
| 3,827,634 | 8/1974 | Hammelmann . | |
| 3,861,409 | 1/1975 | Taniguchi . | |
| 3,991,942 | 11/1976 | Peitl . | |
| 4,051,805 | 10/1977 | Waldrum | 134/152 |
| 4,080,974 | 3/1978 | Oag . | |
| 4,099,674 | 7/1978 | Standley . | |
| 4,104,081 | 8/1978 | Totten | 134/62 |
| 4,133,340 | 1/1979 | Ballard . | |
| 4,139,158 | 2/1979 | Uchida . | |
| 4,237,913 | 12/1980 | Maasberg . | |
| 4,270,702 | 6/1981 | Nicholson . | |
| 4,403,735 | 9/1983 | Weaver . | |
| 4,461,054 | 7/1984 | Oehlenschlager et al. . | |
| 4,600,153 | 7/1986 | Stone . | |
| 4,699,323 | 10/1987 | Rush et al. . | |
| 4,711,277 | 12/1987 | Clish . | |
| 4,828,178 | 5/1989 | Tucker et al. . | |
| 4,991,314 | 2/1991 | Allen . | |
| 5,052,626 | 10/1991 | Wood et al. . | |
| 5,080,283 | 1/1992 | Kukesh et al. . | |
| 5,092,356 | 3/1992 | Grot . | |
| 5,110,366 | 5/1992 | McGregor . | |
| 5,125,425 | 6/1992 | Folts et al. . | |
| 5,135,014 | 8/1992 | Beswick . | |

FOREIGN PATENT DOCUMENTS

| | | | |
|---|---|---|---|
| 654570 | 6/1951 | United Kingdom | 134/167 R |

*Primary Examiner*—Frankie L. Stinson
*Attorney, Agent, or Firm*—Scully, Scott, Murphy & Presser

[57] ABSTRACT

In an automatic bottle washing machine, a nozzle spray system for spraying an internal bottom surface of a bottle or container that is rotatable about its central vertical axis. The nozzle spray system includes a nozzle body having a centralized bore for receiving pressurized fluid, a plurality of discharge orifices located in a staggered, spaced apart pattern on the surface of the nozzle body, and a plurality of elongated microbores to connect a respective one of the plurality of discharge orifices to the centralized bore. When the nozzle body is positioned within an invertedly positioned bottle, cleaning fluid is discharged from the plurality of discharge orifices in well focused jets toward adjacent regions of the internal bottom surface of the bottle. Simultaneously, the bottle is caused to rotate about its vertical axis so that the combination of the rotation of the bottle and the impingement of the well focused fluid jets enable the mechanical peeling off of the residual layers of grime located at the bottom surface of the bottle.

20 Claims, 4 Drawing Sheets

NOZZLE SPRAY ASSEMBLY

BACKGROUND OF THE INVENTION

1. Field of the Invention

The present invention generally relates to a spray nozzle and orifice assembly. Particularly, this invention is drawn to a novel spray nozzle assembly that is designed to discharge highly directional pressurized jets of cleaning fluid such that, when positioned in an inverted rotatable bottle, maximum cleansing of the bottle or container is accomplished.

2. Discussion of Prior Art

Current nozzle systems for spraying the inside of bottles come in a variety of configurations. The most common design comprises an elongated tube or conduit that supports a nozzle spray head having one or more discharge apertures or orifices. Typically, this spray nozzle is inserted in a bottle which is usually held in an inverted position. Water, air, and detergents individually or in various combinations, are discharged from the nozzle spray head orifices to clean and rinse the bottle before refilling it with a beverage product. Representative of the above described common design are the spray nozzle systems disclosed in U.S. Pat. Nos. 2,227,734 and 4,099,674 which describes reciprocating spray nozzles that move up and down within of a stationary bottle, that is moved intermittently, to spray jets of fluid therein. In U.S. Pat. No. 4,099,674, the nozzle head has an annular lateral aperture for discharging a 360° flat spray against the bottle sidewall and has a central discharge orifice at the head of the nozzle for discharging a cylindrical stream at the bottom portion of the bottle. In U.S. Pat. No. 2,227,734, the spray nozzle includes three longitudinally positioned orifices.

A different concept for spraying the inside of bottles is described in U.S. Pat. Nos. 1,652,599 and 5,092,356. These spray nozzle systems do not provide for the spray nozzle to be inserted within the confines of an invertedly positioned bottle, but instead use a fluid delivery pipe having a nozzle unit with a discharge bore that is oblique or perpendicular to the axis of the pipe. In U.S. Pat. No. 5,092,356, the pipe and nozzle unit rotates, with spray jets issuing from the discharge bore form a surface of a shallow cone. Thus, the spray jets impinge solely on the bottle sidewall and only reach the bottom of the bottle by deflection.

In all of these nozzle systems, the bores forming the discharge apertures are short-throw compared to the size of the orifices, and result in fluid jets that are largely unfocused and not well defined. Moreover, these systems do not contemplate or provide for the rotation of the inverted bottle which helps to increase the cleaning effectiveness in high speed bottle cleaning operations.

U.S. Pat. Nos. 3,536,263 and 5,125,425 both disclose spray nozzles which produce high energy jets which loosens and detaches particular matter struck by the jet.

U.S. Pat. Nos. 2,925,224 and 4,828,178 both disclose extremely small nozzle orifices, but neither of these references disclose an elongated bore of small diameter.

U.S. Pat. No. 4,828,178 discloses the use of Electron Discharge Machining for forming a spray disk, but not for forming an elongated bore of small diameter.

Furthermore, the fluids issuing from discharge orifices found in current spray nozzle systems cannot effectively clean the difficult to reach bottom portions of a bottle interior, for e.g., the annular seating ring portion of a Champagne type bottle, without some sort of pretreatment bath or other cleansing steps which are time consuming and not cost effective. Thus, in these designs, effective cleaning depends primarily on the chemistry of the fluids discharged rather than by mechanical impingement.

Accordingly, a nozzle spray system that provides for the rotation of an inverted bottle while being sprayed with fluid jets would be highly desirable for increasing the cleaning effectiveness in high speed bottle cleaning operations. Additionally, a spray nozzle system having elongated microbores with small discharge orifices that will discharge fluid streams in oriented and well defined paths would be extremely desirable.

Moreover, it would be highly desirable for a spray nozzle to discharge fluid jets in a predetermined pattern such that when in combination with a rotating bottle, hard to reach soils accumulated at the bottom of a bottle can be effectively cleaned in shorter periods of time.

SUMMARY OF THE INVENTION

It is an object of this invention is to provide a nozzle spray and orifice assembly having a plurality of elongated microbores with discharge orifices that are arranged in a predetermined spaced apart pattern.

Another object of this invention is to provide a nozzle spray and orifice assembly that discharges jets of pressurized cleaning fluid within a rotatable invertedly positioned bottle, said fluid jets cooperating with the rotation of the bottle to mechanically peel off layers of beverage product film and residue located at the bottom inner surface of the bottle.

Still another object of this invention is to provide a nozzle spray and orifice assembly that is provided with elongated microbores having an elongated length to diameter ratio to ensure that fluids under pressure exit each corresponding discharge orifice in a sharp well defined path.

Yet still another object of this invention is to provide a nozzle spray and orifice assembly that is used in a high-speed automatic bottle washer spraying system wherein the cleaning of the internal bottom surface of the bottle is accomplished in less than 20 seconds, and preferably within 16 seconds.

The present invention is directed to a nozzle and orifice assembly that is inserted into an inverted bottle or container to clean the inside and bottom surface thereof. The nozzle and orifice assembly comprise a nozzle body having seven discharge orifices located in a spaced apart relation in the nozzle body. The nozzle body has a centralized bore for connection to a pressurized fluid supply line. Six elongated microbores extend from the centralized bore in a symmetrical pattern with each microbore ending in a respective discharge orifice. The seventh elongated microbore extends centrally and axially within the nozzle body with the other six microbores forming acute angles relative thereto. When the nozzle body is positioned within the inverted bottle, cleaning fluid under pressure is discharged from each orifice toward the internal bottom surface of the bottle and impinges upon the bottom surface in the spaced apart pattern. Simultaneous therewith, the bottle is rotated about its vertical axis to cooperate with the pattern of impinging jets of cleaning solution to mechanically peel away any beverage film and residue that remains on the bottom inner surface of the bottle.

Further benefits and advantages of the invention will become apparent from a consideration of the following detailed description given with reference to the accompanying drawings, which specify and show preferred embodiments of the invention.

DETAILED DESCRIPTION OF PREFERRED EMBODIMENTS

Figure 1A:
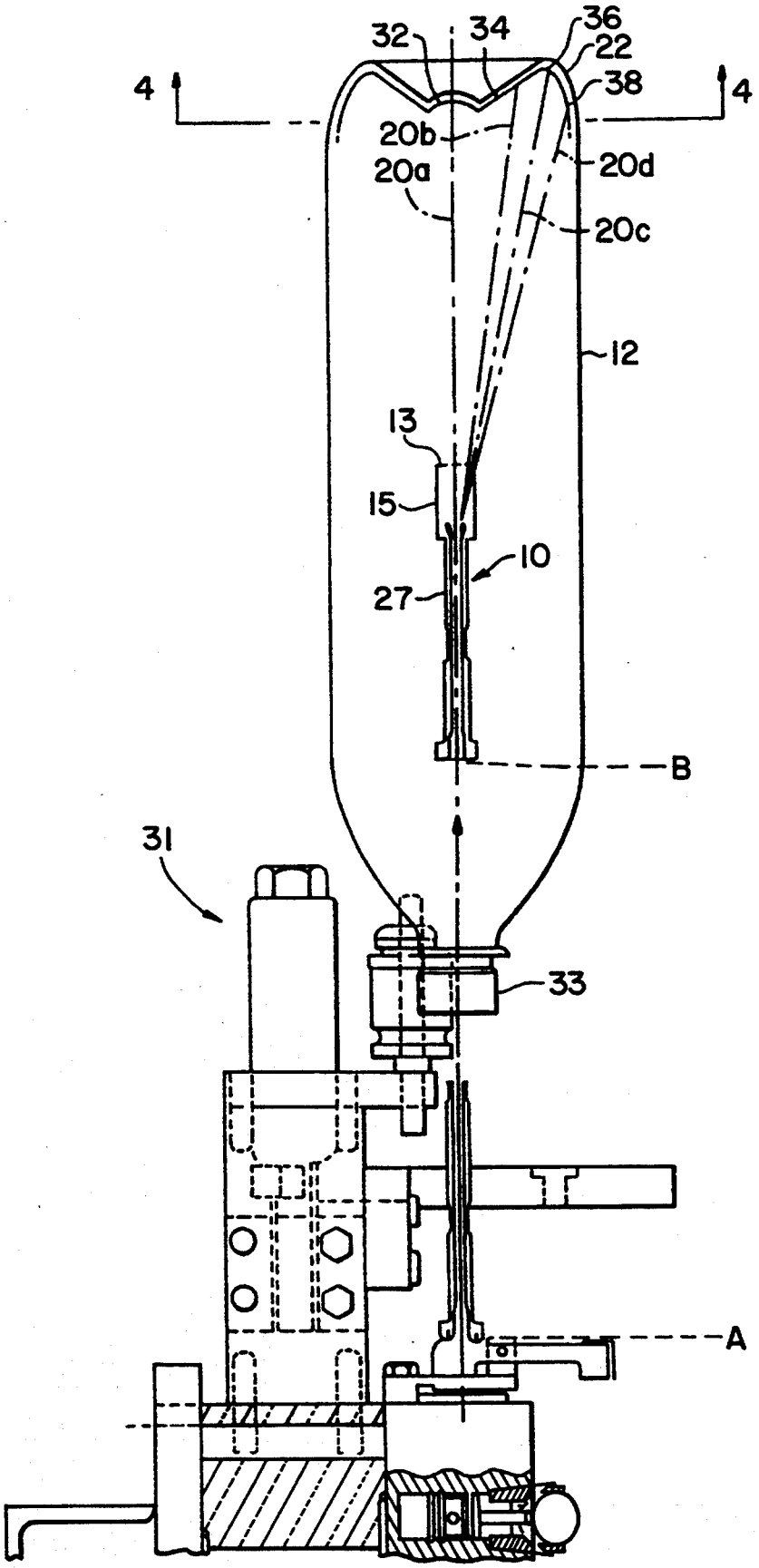
FIG. 1*a* is a view of the nozzle spray assembly shown inserted in a 1.5 liter bottle and discharging pressurized fluid therein.

Referring to FIG. 1*a* there is shown the nozzle spray assembly 10 of the instant invention comprising a nozzle body 15 and fluid driven lance 27 that is disposed within an inverted 1.5 liter bottle 12. In the preferred embodiment, bottle 12 is a returnable/refillable blow-molded plastic bottle made of homopolymer polyethylene terephthalate or copolymers thereof. The bottle preferably may range in size from 0.5 liter to 2 liters, with 1.5 and 2.0 liter bottles depicted herein for description purposes, but it is understood that any size of plastic or glass bottle may be cleaned. Nozzle body 15 is preferably cylindrical shaped and is preferably formed of stainless steel because of its ability to withstand the detergents and chemicals present in the cleaning solution used in this environment.

As shown in FIG. 1*a*, jets of pressurized cleaning fluid 20*a*–*d* are discharged in focused and precise paths from the surface 13 of nozzle body 15 and directed at the internal surface of the base region 22 of the 1.5 liter bottle 12. For clarity, FIG. 1*a* shows all discharged sprays exiting at only one side of nozzle body 15 but, as will be explained in detail below, the discharge orifices are arranged around the top of the nozzle and jets are also discharged from the other side of nozzle body 15 and directed at the other side of the base region 22. In the preferred embodiment, the cleaning fluid is an alkaline solution such as NaOH, but any type of cleaning or sanitizing fluid may be used in the nozzle spray assembly 10 of the instant invention.

Figure 2:
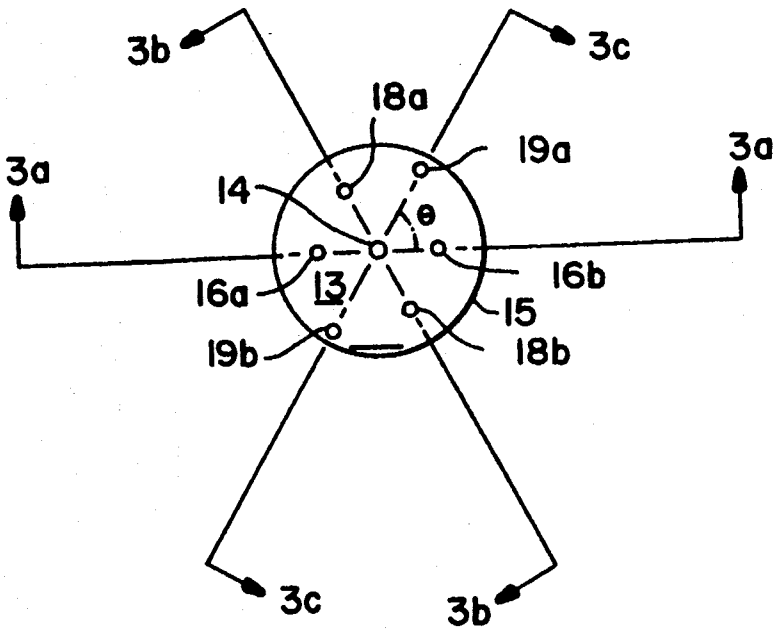
FIG. 2 is an overhead view of the nozzle body showing the locations of the discharge orifices of the nozzle spray assembly.

FIG. 2 shows the top view of the surface 13 of nozzle body 15 of the instant invention. As can be seen, there is a central orifice 14, a first pair of orifices 16*a,b* located along the broken line labelled 3*a*, a second pair of orifices 18*a,b* located along the broken line 3*b*, and a third pair of orifices 19*a,b* located along the broken line 3*c*. The central orifice 14 is located equidistant between each pair of orifices 16*a,b*, 18*a,b* and 19*a,b*. Each consecutive orifice, e.g., 16*b* and 19*a*, is radially spaced $\pi/3$ radians or 60° from the prior orifice as shown by the angle $\Theta$ in FIG. 2. As can be seen, the locations of each consecutive orifice is staggered and not concentric relative to the central orifice 14. As viewed in FIGS. 3*a,b*, and *c*, the surface 13 of nozzle body 15 is conical in shape; the central orifice 14 being located at the apex of the surface 13.

Figure 3C:
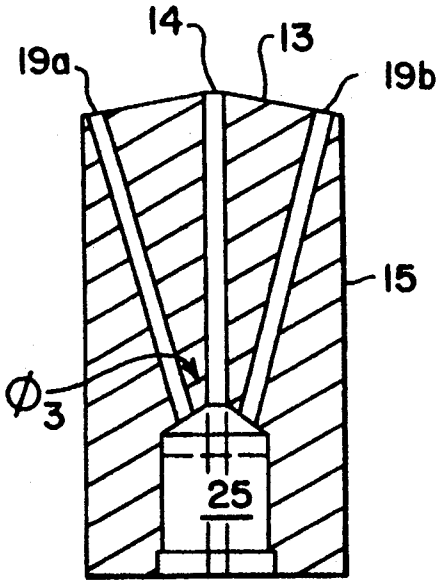
FIG. 3*c* is a cutaway view of the nozzle body taken along line 3*c*–3*c* of FIG. 2.
Figure 3B:
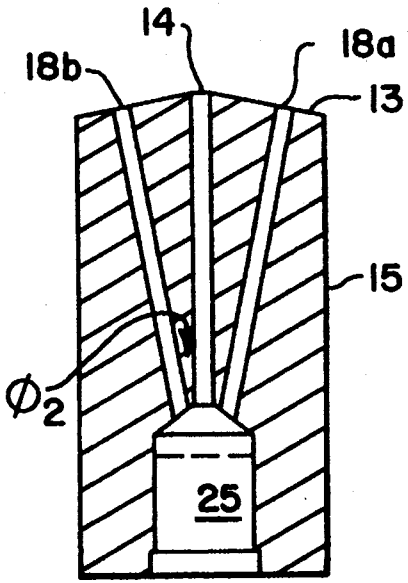
FIG. 3*b* is a cutaway view of the nozzle body taken along line 3*b*–3*b* of FIG. 2.
Figure 3A:
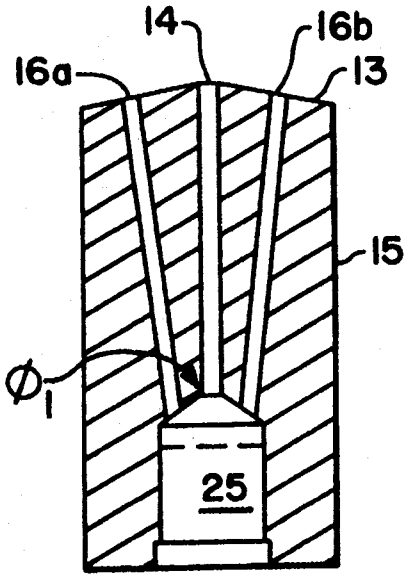
FIG. 3*a* is a cutaway view of the nozzle body taken along line 3*a*–3*a* of FIG. 2.

FIGS. 3*a*, *b* and *c* show detailed cut-away views of the nozzle body 15 taken along the corresponding lines 3*a*, *b* and *c* of FIG. 2. FIG. 3*a* shows the nozzle body 15 having a wide centralized bore 25 that is screw threaded for attachment to various positioning devices such as the fluid driven lance 27 shown in FIG. 1*a* the operation of which is disclosed in copending U.S. patent application Ser. No. 090,501 assigned to the same assignee of the present invention. Two elongated microbores extend from the centralized bore 25 to form the two orifices 16*a,b* taken along line 3*a* of FIG. 2. A third elongated microbore extends from centralized bore 25 to form the orifice 14 of nozzle body 15. The elongated microbore 14 is common to all three views of nozzle body 15 respectively illustrated in FIGS. 3*a*, *b* and *c*, and is shown central and vertically axial therein.

Likewise, in FIG. 3*b*, two elongated microbores extend from the centralized bore 25 to form the two orifices 18*a,b* located along line 3*b* of FIG. 2. In FIG. 3*c*, two elongated microbores extend from the centralized bore 25 to form the two orifices 19*a,b* located on line 3*c* of FIG. 2. The microbores and their corresponding orifices described hereinabove are specially designed to enable the discharge of very sharp and well focused fluid jets. In the preferred embodiment, each elongated bore and corresponding orifice has a diameter of 0.6 mm and is created by electron discharge machining.

Additionally, in the preferred embodiment, the ratio of the length of each elongated microbore to the diameter of each microbore ranges from about 22:1 to 28:1. Preferably, the length of each microbore is about 16.0 mm and the diameter of each microbore is approximately 0.65 mm resulting in a length to diameter ratio of approximately 25:1. Ratios of microbore length to microbore diameter in this range ensures that the fluid dynamics of the jet is well aligned in each microbore prior to discharge and that the fluid jets exiting each orifice exit in sharp, well-focused paths. The cleaning fluid jets which exit each orifice will keep their shape throughout its trajectory and will impinge upon the inner bottle surfaces with essentially the same mean width and with little elimination in force from the time of discharge. This is essential for high-speed cleaning required of automated washer spraying systems. Too many orifices discharging an excessive amount of fluid will create too many deflections at the inner bottle surfaces as they impinge upon each other thus increasing interference and disrupting effective cleaning action. Furthermore, orifices having larger diameter will cause extraneous discharge that may interfere or collide with other fluid discharge paths, decreasing the effectiveness of the mechanical cleansing.

The microbores have been sized to provide adequate fluid delivery and impact at a operating pressure of 20 to 80 p.s.i. in the nozzle supply line while other pressures and microdiameters could be used, the foregoing range is commonly available, with the most prevalent operating pressure being 40 p.s.i.

In FIG. 3*a*, the elongated microbores forming orifices 16*a* and 16*b* are acutely angled relative to the microbore forming orifice 14. In the preferred embodiment, the angle $\phi_1$ formed between elongated microbores 16*a* (16*b*) and central microbore 14 is approximately 7° (±10′) as shown in FIG. 3*a*. In FIG. 3*b*, elongated microbores 18*a* and 18*b* are similarly acutely angled relative to the central microbore 14 with the angle $\phi_2$ formed between the elongated microbores 18*b*(18*a*) and central microbore 14 is approximately 11° (±10′). Likewise, in FIG. 3*c*, the angle $\phi_3$ formed between the elongated microbores 19*a* (19*b*) and central microbore 14 is 15° (±10′). It should be understood that slight variations of the acute angles formed between the elongated microbores and the central microbore may exist depending upon the size and configuration of the bottle 12. For instance, a nozzle body 15 for spraying the internal bottom surface of the 2.0 liter bottle 12 shown in FIG. 1*b*, would have elongated microbores forming acute angles of $\phi_1=6°\pm(10^1)$, $\phi_2=9°\pm(10^1)$, and $\phi_3=14°\pm(10^1)$ relative to the central elongated microbore 14.

To maintain effective and maximum mechanical cleaning of the bottom interior surface 22 of the bottle, the locations and inter-relationship of the locations of the orifices 14, 16*a,b*, 18*a,b* and 19*a,b* and the location of the nozzle body 15 within the bottle 12 are critical.

Figure 1B:
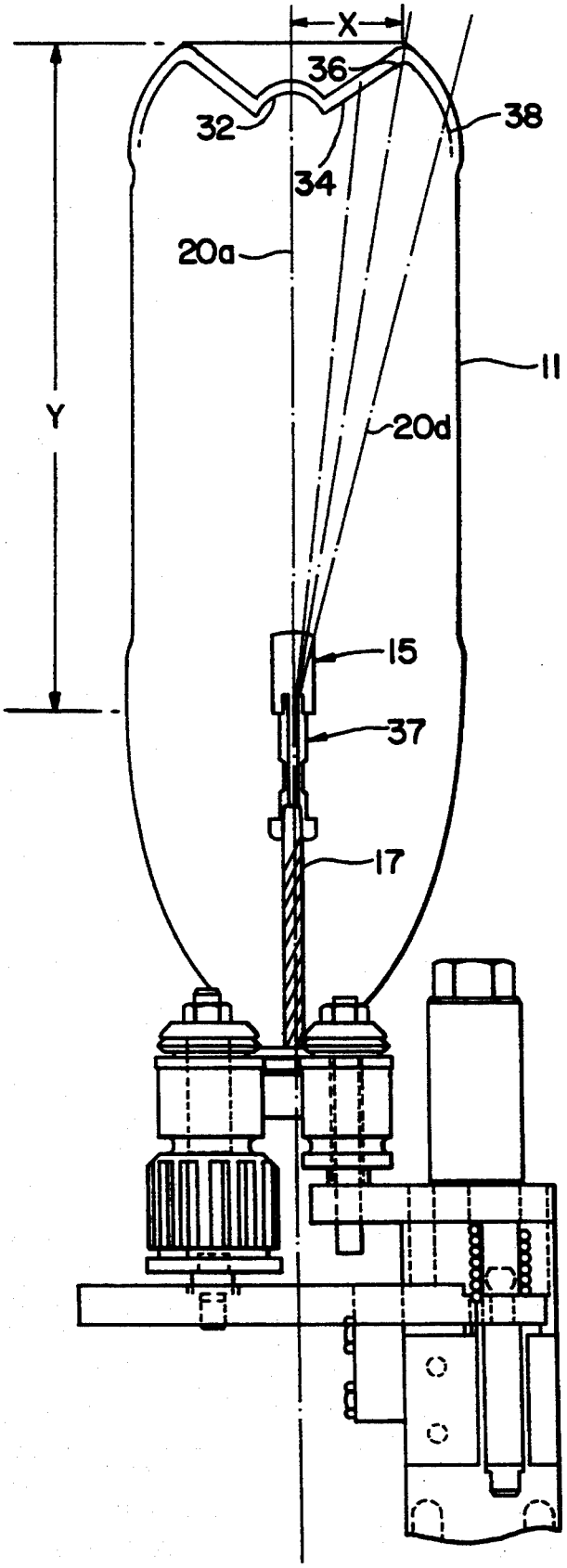
FIG. 1*b* is a view of the nozzle spray assembly shown inserted in a 2.0 liter bottle and discharging pressurized fluid therein.

The cleansing operation of the nozzle spray assembly will now be described with respect to FIG. 1*a*, where it can be seen that bottle 12 is held in an inverted position by a suitable bottle gripping device 31 such as the bottle holder and rotating device disclosed in copending U.S. patent application Ser. No. 090,413 assigned to the same assignee as the present invention and incorporated by reference herein. The bottle gripping device 31 is configured so that the open neck portion 33 is unobstructed to permit easy insertion of the nozzle spray assembly 10. In the preferred embodiment, the nozzle spray assembly 10 is registered for insertion into the inverted bottle 12 as the bottle 12 moves along a path of an automatic rotary or in-line bottle washing machine. FIG. 1*a* shows generally the nozzle spray assembly 10 in position "A" directly below the open neck 33 of the inverted bottle 12 before the nozzle spray assembly is inserted. At the appropriate time during a washing cycle of the bottle washing machine, cleaning fluid under a pressure of 40 p.s.i. is caused to flow from a central commutator (not shown) to the nozzle spray assembly 10 at position A shown in FIG. 1*a*. The lance 27 upon which the nozzle body 15 is connected, is fluid driven, and the pressurized cleaning fluid entering the lance 27 causes the lance 27 to travel a precise and predetermined distance within the body of the inverted bottle 12. FIG. 1*b* shows the lance 27 connected to a fluid supply line 17 for supplying the pressurized cleaning fluid at 40 p.s.i. and at a flow rate of 0.5 liters per minute to the nozzle body 15 for discharge therein. The lance 27 is designed to travel a predetermined distance in the direction indicated by the arrow in FIG. 1*a* to the position "B" within the confines of bottle 12.

Simultaneous with the insertion of the nozzle spray assembly 10 within bottle 12, the bottle 12 is rotatably driven by the gripping device 31. In the preferred embodiment, the bottle 12 is caused to rotate in a counterclockwise direction at a rate of anywhere from 5–20 r.p.m. but preferably 10 r.p.m. Spray jets 20*a–d* of cleaning fluid are then discharged from the nozzle body 15 at each orifice at a pressure of 40 p.s.i. The impinging spray jets 20*a–d* in combination with the rotation of the bottle 12, the amount of fluid flow through each nozzle, and the pressure, results in an effective cleaning of the inner bottom surface 22.

Figure 4:
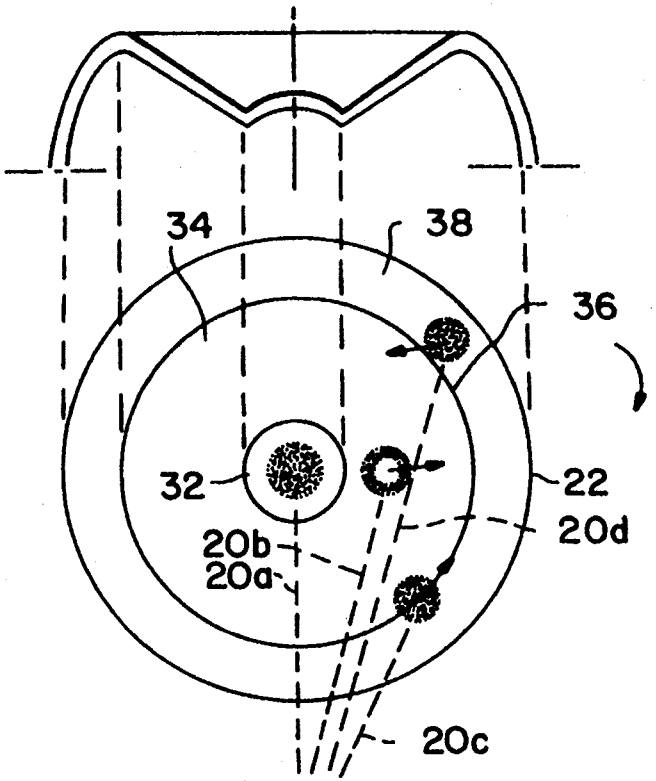
FIG. 4 is a view of the base region of the bottle, as taken along line 4—4 of FIG. 1*a*.

The staggered locations of points where the spray jets 20*a–d* impinge upon the bottom surface of the bottle is shown in FIG. 4. As shown therein, the fluid spray jet 20*a* discharged from the central orifice 14 of the nozzle body 15 is directed to impinge the central base region 32 of the bottle 12. The fluid spray jet 20*b* is directed to impinge the region 34 of the base 22 adjacent to the central region 32. This fluid spray jet is discharged from orifice 16*b*. As illustrated in FIG. 1*a*, the base region 34 of the bottle is the sloping portion of a conically recessed base or champagne type base. The fluid spray jet 20*c* is directed to impinge the region 36 of the base 22 that is adjacent to base region 34. This spray jet is discharged from orifice 18*b*. As FIG. 1*a* illustrates, base region 36 is an annular seating ring where the recessed portion of the base meets the semi-spherical sidewall 38. Fluid spray jet 20*d* is directed to impinge the interior sidewall 38 of the base and is discharged from orifice 19*b* of nozzle body 15. It is understood that the opposite side of the base 22 is also subject to fluid spray jets that emanate from the other orifices 16*a*, 18*a* and 19*a* and that fluid is discharged simultaneously from each orifice of nozzle body 15.

As previously mentioned, the rotation of bottle 12, preferably in the counterclockwise direction shown in FIG. 4, maximizes the mechanical cleansing of the inner surface 22 of the bottle because impinging pressurized spray jets 20*a–d* act to peel off layers of debris on the inner surface of the bottle as the bottle rotates. In addition, the staggered impingement locations enables maximum cleansing while minimizing interference caused by the deflection of one spray jet of the bottle wall and into the path of another spray jet. For instance, as FIG. 4 illustrates, the fluid spray jet 20*b* impinging upon region 34 of the base peels off debris in the direction indicated by the arrow and is deflected toward the base region 36 which is itself subject to spray jet 20*c* discharged from orifice 18*b*. However, the circumferentially spaced apart relation of the impinging jets 20*b* and 20*c* as determined by discharge orifices 16*b* and 18*b* of nozzle body 15 is such that the deflection of fluid spray jet 20*b* and any peeled off debris will not appreciably interfere with the flow of fluid spray jet 20*c*. Likewise, the spray jet 20*d* impinging upon the inner surface of the interior sidewall 38 peels off debris in the direction indicated by the arrow and is again deflected toward the base region 36. The spaced apart relation of the impinging jets 20*d* and 20*c* as determined by discharge orifices 16*b* and 19*a* of nozzle body 15 is such that the deflections of fluid spray 20*d* and peeled off debris will not interfere with the flow of fluid jet 20*c*. The combined mechanical and chemical cleaning enables the cleansing of the bottle in 15 to 20 seconds, as opposed to approximately 12 minutes in a conventional soak tank using the same chemical cleaning agent.

After the internal surface 22 of the bottle 12 has been sprayed, fluid driven lance 37 may be lowered or recalled by air pressure to its original position "A" (FIG. 1*a*).

The nozzle spray assembly 10 is adaptable for spraying the internal surface of any sized bottle. To ensure the directional accuracy of the spray jets 20*a–d*, while keeping the fluid pressure constant at 40 p.s.i., the lance 27 may be replaced with a lance of a different length corresponding to the size of the bottle. For instance, to clean the 2.0 liter bottle 11 shown in FIG. 1*b*, a shorter lance 37 supporting the nozzle body 15 is used to ensure that the spray jets 20*a–d* are directed to the same internal bottom surfaces 32, 34, 36 and 38 as in the 1.5 liter bottle of FIG. 1*a*.

The size of the lance is determined by the size of the bottle. As shown in FIG. 1*b*, the distance Y from the nozzle body 15 to the bottom surface of the bottle is determined according to equation (1), $$Y = \arctan \phi_i(X_i) \quad (1)$$

where $X_i$ is the horizontal distance from the center bottom of the bottle to the point where one of the spray jets impinges the bottom surface of the bottle, or would impinge the bottom surface of the bottle but for the sidewall 11 or recessed portion of the bottom interior and $\phi_i$ is the angle formed between the central vertical axis of the bottle and the spray jet impinging upon the bottom surface of the bottle a distance $X_i$ from the bottom center.

While the invention has been shown and described with respect to preferred embodiments thereof, it will be understood by those skilled in the art that the foregoing and other changes in form and details may be made therein without departing from the spirit and scope of the invention, which should be limited only by the scope of the appended claims.

We claim:

1. A nozzle and orifice assembly for cleaning an internal surface of a returnable bottle upon its return, prior to refilling, said internal surface having residual soiled locations, said bottle being rotatable about a vertical axis while simultaneously moving along a predetermined path in an inverted position, said nozzle system comprising:

a nozzle body having a plurality of discharge orifices located in a predetermined spaced apart pattern on a surface thereof and a centralized bore for receiving pressurized fluid;

a plurality of elongated microbores for connecting each respective orifice to said centralized bore for discharge of pressurized fluid therethrough;

means for positioning said nozzle body within said inverted bottle and registering said nozzle body within said inverted bottle as said bottle moves along said predetermined path;

wherein cleaning fluid under pressure is discharged in sharp, well focused jets determined by said spaced apart pattern of discharge orifices toward said internal surface and impinging at points upon said internal bottom surface in said spaced apart pattern such that when said bottle is rotated about its vertical axis, a mechanical peeling of residue at said residual soiled locations of said returnable bottle is accomplished by the combined action of said jets and said rotation.

2. A nozzle assembly according to claim 1 having a predetermined spray pattern of at least three impinging jets which discharge from said nozzle at angles $\phi_i$ ranging from 6° to 16° relative to a vertical axis of said bottle to impinge the internal bottom surface of said bottle when positioned at a predetermined distance Y from the bottom of said bottle, wherein $Y = \arctan \phi_i(X_i)$; wherein $X_i$ is a horizontal distance measured from the center of said bottom to a point where one of said jets impinges said internal bottom surface.

3. A nozzle assembly according to claim 2 wherein said positioning means includes means for varying the distance of said nozzle body within said bottle depending upon the size of said bottle to be cleaned.

4. A nozzle assembly according to claim 3 wherein said means for varying the position of said nozzle body is a tubular spacer element.

5. A nozzle assembly according to claim 2 wherein said positioning means is a fluid driven piston that is responsive to the pressure of said cleaning fluid supplied thereto.

6. A nozzle assembly according to claim 2 wherein said centralized bore of nozzle body is connected to and detachable from said positioning means.

7. A nozzle assembly according to claim 2 wherein said positioning means further includes means for removing said nozzle body from said bottle.

8. A nozzle assembly according to claim 1 wherein one of said plurality of elongated microbores and corresponding discharge orifice is substantially vertical and central within said nozzle body.

9. A nozzle assembly according to claim 8 wherein each of the other of said plurality of discharge orifices and corresponding elongated microbores is spaced apart at a respective acute angle relative to said substantially vertical and central elongated microbore.

10. A nozzle assembly according to claim 9 wherein said other of said plurality of discharge orifices on said nozzle body surface is radially spaced apart from each other at an angle of substantially $\pi/3$ radians.

11. A nozzle assembly according to claim 10 wherein a first pair of said other of said plurality of said elongated microbores means is disposed at an angle of substantially 15°±1° relative to said central vertical elongated microbore of a second pair of said other of said plurality of elongated microbores is disposed at an angle of substantially 11°±1° relative to said central vertical elongated microbore, and a third pair of said other of said plurality of elongated microbores is disposed at an angle of substantially 7°± 1° relative to said central vertical elongated microbore, wherein each discharge orifice of a respective pair is radially displaced apart from each other on said nozzle body surface at an angle of substantially $\pi$ radians.

12. A nozzle assembly according to claim 11 wherein fluid discharged from said first pair of said other of said plurality of said discharge orifices mechanically impinges upon a first annular region of said internal bottom surface of said bottle and in combination with rotation of said bottle, mechanically peels off debris from said first annular region of said internal bottom surface.

13. A nozzle assembly according to claim 12 wherein cleaning fluid discharged from said third pair of said other of said plurality of said discharge orifices mechanically impinges upon a second annular region of said internal bottom surface of said bottle and in combination with rotation of said bottle, mechanically peels off debris from said second annular region of said internal bottom surface.

14. A nozzle assembly according to claims 13 wherein said cleaning fluid discharged from said second pair of said other of said plurality of said discharge orifices means mechanically impinges upon a region adjacent said first and second regions of said internal bottom surface of said bottle.

15. A nozzle assembly according to claim 8 wherein said surface of said nozzle body is conical and said discharge orifices corresponding to said substantially vertical and central elongated microbores is located at the apex of said conical surface.

16. A nozzle assembly according to claim 8 wherein said cleaning fluid discharged from said central and vertical discharge orifice mechanically impinges upon a central region of said internal bottom surface.

17. A nozzle assembly according to claim 1 wherein said cleaning fluid is discharged from said plurality of discharge orifices at a pressure of 40 p.s.i.

18. A nozzle assembly according to claim 17 wherein said cleaning fluid discharged from each of said plurality of discharge orifices is deflected after mechanical impingement with respective regions of said internal bottom surface of said bottle, and further characterized in that said cleaning fluid deflections do not interfere with an adjacent cleaning fluid discharge path.

19. A nozzle assembly according to claim 1 wherein said bottle rotates at a rate of substantially 10 r.p.m.

20. A nozzle assembly according to claim 1 wherein said plurality of elongated microbores each have a diameter of 0.6 mm.

* * * * *

UNITED STATES PATENT AND TRADEMARK OFFICE

CERTIFICATE OF CORRECTION

PATENT NO. : 5,419,348

DATED : May 30, 1995

INVENTOR(S) : Ken Kuta

It is certified that error appears in the above-indentified patent and that said Letters Patent is hereby corrected as shown below:

On the Title Page, Section 56, under "U.S. PATENT DOCUMENTS" line 12, after "Hayward" insert the following: --2,818,873 1/58 Carlson et al.-- and Column 2, line 5 after "Weaver" insert the following: --4,442,934 4/84 Dorf et al.--

On the Title Page, Section 56, under "FOREIGN PATENT DOCUMENTS" on line 2, insert the following:

| | | | |
|---|---|---|---|
| -- | 408,950 | 4/10 | France |
| | 492,206 | 2/30 | Germany |
| | 377,444 | 7/32 | United Kingdom |
| | 991,641 | 10/51 | France |
| | 33 16 405 | 11/84 | Germany |
| | 0 180 706 | 5/86 | European |
| | 40 16 950 | 11/91 | Germany-- |

Signed and Sealed this

Seventh Day of May, 1996

Bruce Lehman

*Attest:*

BRUCE LEHMAN

*Attesting Officer*

*Commissioner of Patents and Trademarks*